United States Patent [19]

Wideman

[11] 4,158,430

[45] Jun. 19, 1979

[54] GRAVITY OPERATED FLAG INDICATOR DEVICE FOR MAILBOXES

[76] Inventor: Ewell F. Wideman, 305 Crommelin Dr., Wetumpka, Ala. 36092

[21] Appl. No.: 917,486

[22] Filed: Jun. 21, 1978

[51] Int. Cl.[2] ..... A47G 29/12

[52] U.S. Cl. ..... 232/35

[58] Field of Search ..... 232/35, 34

[56] References Cited

U.S. PATENT DOCUMENTS

| | | | |
|---|---|---|---|
| 706,843 | 8/1902 | Moore | 232/35 |
| 3,602,424 | 8/1971 | Raulston | 232/35 |
| 4,051,997 | 10/1977 | Garcia | 232/35 |

*Primary Examiner*—Francis K. Zugel

*Attorney, Agent, or Firm*—Larson, Taylor & Hinds

[57] ABSTRACT

A gravity operation flag indicator device for a mailbox is provided which includes a simple latching mechanism operable responsive to opening and closing of the door of the mailbox. The device includes a flag indicator which is pivotably mounted in a side wall of the mailbox and has affixed thereto a latching arm which is disposed inside of the mailbox. The latching arm is mounted adjacent to the mailbox door and is of such dimensions that when the latching arm extends horizontally, the end thereof will be engaged by the door when the door is closed and thus the flag indicator will be held in a horizontal position. When the door is opened by the mailman, the latching arm is automatically released from engagement with the door and the flag indicator falls by its own weight to a vertical position to indicate that the mail has been delivered.

1 Claim, 3 Drawing Figures

GRAVITY OPERATED FLAG INDICATOR DEVICE FOR MAILBOXES

BACKGROUND OF THE INVENTION

A number of gravity-operated flag or signal devices for mailboxes have been devised in the prior art. Some examples of such devices are those disclosed in U.S. Pat. Nos. 823,791 (Kitchen); 878,036 (Brown); 1,456,543 (Feist); 1,530,150 (Allan); 2,353,915 (Roe); 3,143,287 (Holt); 3,325,092 (Hoffman); 3,602,424 (Raulston) although it will be understood that this listing is not, and is not represented to be, exhaustive. The Kitchen patent discloses a mailbox signal including a flag-type indicator having a crescent-shaped cam affixed to one end thereof and disposed within the mailbox. A spring member affixed to the mailbox cover includes a V-shaped lug which engages the cam when the cover is closed so as to maintain the flag in an upright position. When the cover is lifted, the lug is disengaged and the flag falls by its own weight to an inoperative position. The Roe patent discloses a gravity-operated mailbox flag which is pivotably mounted and is slotted or notched at one end so as to engage an angle bar mounted on the mailbox door. When the mailbox is opened, the flag is released and falls to an inoperative position. The Holt patent discloses a mailbox signal device including a flag which pivots away from the mailbox when a tab thereon is released from engagement with a flange on the mailbox door by opening of the door. The Hoffman and Raulston patents disclose gravity operated, flag-type signal devices wherein the flag drops under the force of gravity to a second position thereof when a tab carried by the mailbox door is released in response to the opening of the door. The remaining patents disclose similar devices for indicating when the mailbox door or cover has been opened.

Although the devices disclosed in these patents will serve their intended function, the devices, as discussed hereinbelow, do suffer certain disadvantages as compared to the gravity operated, flag indicator device of the present invention.

SUMMARY OF THE INVENTION

In accordance with the invention, a gravity operated flag indicator device for mailboxes is provided which, while similar to the prior art discussed hereinabove, differs in important regards from the prior art and provides substantial advantages thereover. More specifically, the device of the invention, in contrast to most of the devices discussed above, provides for location of the operating mechanism for the flag indicator inside of the mailbox thereby affording protection for the operating mechanism from the weather as well as damage from abuse and wear. In addition, the device of the present invention is extremely simple in construction and, in a simple and effective manner, provides a clear visual indication of whether or not the associated mailbox has been opened and thus whether or not the mailman has delivered the mail.

According to a preferred embodiment of the invention, a gravity operated flag indicator device is provided in combination with a mailbox, the flag indicator device comprising a flag indicator, a latching arm affixed to the flag indicator, means for pivotably mounting the flag indicator with respect to the mailbox so that the flag indicator is disposed outside of the mailbox and the latching arm is disposed within the mailbox adjacent to the mailbox door, the dimensions, and location, of the latching arm being such that when the mailbox door is closed and the latching arm is in the horizontal position thereof, the free end of the latching arm engages the inside wall of the door so as to be prevented from pivoting and thereby latches said flag indicator in a first, horizontal position thereof. When said door is opened, the latching arm is released from engagement with the door so that the flag indicator can pivot under the force of gravity to a second, vertical position thereof.

The flag indicator advantageously includes a hub portion which is mounted for rotation in a sidewall of the mailbox while the latching arm, which preferably comprises a curved member having a flat portion at the free end thereof, is connected at the other end to the hub portion of the flag indicator. In the latching position described above, this flat end engages the inside bottom wall or floor of the mailbox directly adjacent to the door while the tip engages the door to prevent pivoting the flag indicator from its horizontal position.

Other features and advantages of the invention will be set forth in, or apparent from, the detailed description of a preferred embodiment found hereinbelow.

DESCRIPTION OF THE PREFERRED EMBODIMENTS

Figure 1:
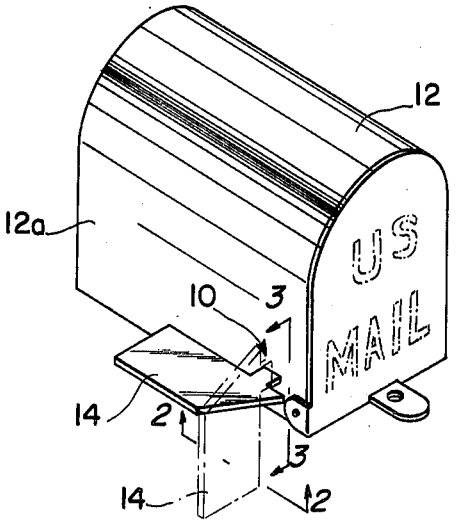
FIG. 1 is a perspective view of a mailbox incorporating the gravity operated flag indicator device of the invention, illustrating the operative positions of the flag.

Referring to FIG. 1, the gravity operated flag indicator device of the invention, generally denoted 10, is shown as incorporated in a standard mailbox 12. As illustrated, the flag indicator device includes a flag member 14 which is movable beween a first, horizontal, latched position shown in solid lines which indicates to the mailbox owner that the mail has not yet been delivered and a second, vertical, unlatched position shown in dashed lines which indicates to the mailbox owner that the mail has been delivered.

Figure 2:
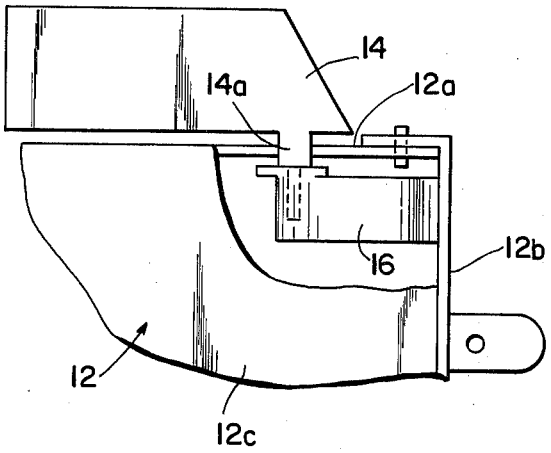
FIG. 2 is a bottom plan view, drawn to an enlarged scale, of a detail of the mailbox of FIG. 1, directed generally as indicated by line II—II, with a portion of the bottom of the mailbox being broken away to show the operating mechanism of the invention.
Figure 3:
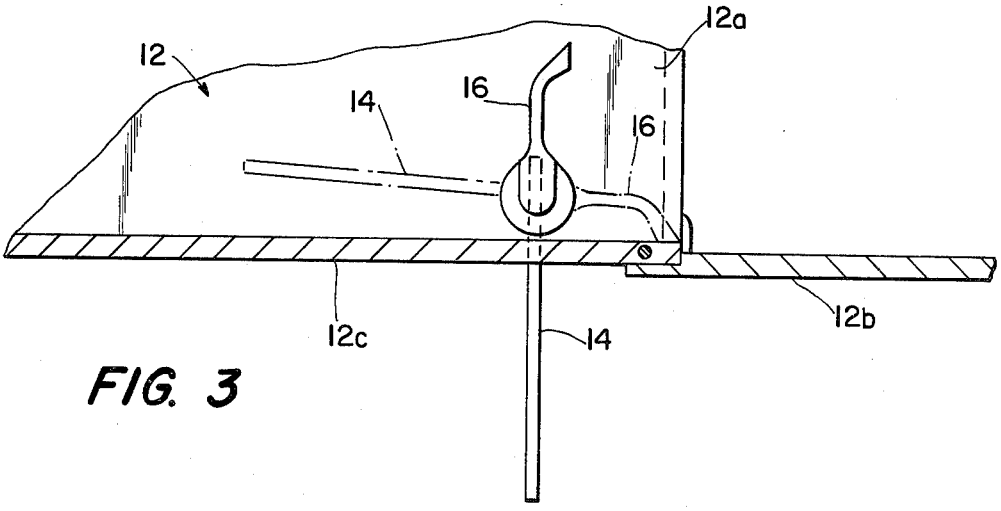
FIG. 3 is a side elevational view, drawn to an enlarged scale and partially broken away, directed generally as indicated by line III—III, and illustrating the latched position of the operating mechanism in dashed lines.

Referring to FIGS. 2 and 3, the operating mechanism of the device is illustrated. Flag 14 includes a hub portion **14*a* which is journalled for rotation in one sidewall 12*a* of the mailbox 12. Rigidly affixed to hub 14*a* is a latching or control arm 16. Latching arm 16 is located within mailbox 12 and the free end thereof, in the horizontal position, extends toward the door 12*b*. As illustrated, the latching arm 16 is disposed just above the bottom wall 12*c* of mailbox 12 and directly adjacent to door 12*b* and, because of the superior weight of flag 14, extends vertically in the normal, unlatched position thereof, as shown in FIG. 3. The dimensions of latching arm 15 and its position relative to door 12*b* are such that when door 12*b* is closed and flag 14 is in the horizontal position thereof (and hence latching arm 16 extends horizontally), the tip end of latching arm 16 engages door 12*b* and thus flag 14 cannot pivot to its normal vertical position. This can be perhaps best appreciated by drawing a first imaginary line from the axis of hub 14***a* horizontal to the mailbox door, i.e., parallel to bottom wall 12*c*, drawing a second imaginary line vertically downwardly from that point to the extreme tip end of arm 16, and drawing a third imaginary line from the tip end of arm 16 back to the axis of hub 14*a*, so that a right triangle is formed. Since the hypotenuse of a right triangle is longer than either of the other two sides, the tip end of arm 16 cannot move from the latched position when door 12*b* is closed. Thus, as illustrated in FIG. 3 in dashed lines, when door 12*b* is closed, indicator flag 14 is held in the horizontal position thereof and when door 12*b* is opened, the tip end of arm 16 is disengaged from door 12*b* and arm 16 is thus unlatched. Under these circumstances, flag 14, under the force of gravity, assumes the vertical position illustrated in solid lines in FIG. 3.

It will be appreciated that the gravity operated flag indicator device of the invention operates automatically to provide an indication of whether the mail has been delivered, the flag 14 simply falling by gravity to the vertical position thereof when the door of the mailbox is opened and the latching mechanism thus released. It will be understood that the flag 14 will remain vertical when the door is closed again and will remain in this position until reset. Resetting, of course, requires nothing more than holding the flag 14 in the horizontal position and closing the door, in that when the door is closed latch 16 automatically assumes the latching position thereof.

Although the invention has been described relative to an exemplary embodiment thereof, it will be understood that other variations and modifications can be effected in this embodiment without departing from the scope and spirit of the invention.

I claim:

1. In combination, a mailbox including a pivotable door and a gravity operated flag indicator device, said flag indicator device comprising a flag indicator, a latching arm affixed to said flag indicator, means for pivotably mounting said flag indicator with respect to the mailbox so that the flag indicator is disposed outside of the mailbox and the latching arm is disposed within the mailbox, said latching arm being disposed adjacent to the door of said mailbox and being shaped and dimensioned such that when said flag indicator is in a first, horizontal position thereof and said door is closed, the free end of said latching arm engages said door to thereby latch said flag indicator in said first, horizontal position thereof, said latching arm being released from engagement with said door when said door is opened so that the flag indicator will pivot under the force of gravity to a second, vertical position thereof, said flag indicator including a hub portion mounted in a sidewall of said mailbox adjacent to the bottom wall of the mailbox, and said latching arm comprising a curved member which includes a portion at the free end which engages the bottom wall of the mailbox in the latched position thereof and a tip end portion of the free end which engages the inside wall of the mailbox door, the straight line distance between the pivot axis of the flag indicator and said tip end portion being greater than the straight line distance between the pivot axis and the inside wall of said door.

* * * * *